US011700959B1

(12) United States Patent
Webster

(10) Patent No.: US 11,700,959 B1
(45) Date of Patent: Jul. 18, 2023

(54) DRINKING VESSEL WITH DIRECTIONAL ILLUMINATION

(71) Applicant: Clint Dale Webster, Sherwood Park (CA)

(72) Inventor: Clint Dale Webster, Sherwood Park (CA)

( * ) Notice: Subject to any disclaimer, the term of this patent is extended or adjusted under 35 U.S.C. 154(b) by 0 days.

(21) Appl. No.: 17/808,155

(22) Filed: Jun. 22, 2022

(51) Int. Cl.
*A47G 19/22* (2006.01)
*F21V 33/00* (2006.01)

(52) U.S. Cl.
CPC ..... *A47G 19/2227* (2013.01); *F21V 33/0036* (2013.01); *A47G 2019/2238* (2013.01); *A47G 2200/08* (2013.01)

(58) Field of Classification Search
CPC ..... A47G 19/2227; A47G 19/2205; A47G 2200/08; A47G 2019/2238; F21V 33/036
USPC ..... 362/101, 96
See application file for complete search history.

(56) References Cited

U.S. PATENT DOCUMENTS 3,246,786 A * 4/1966 Holley ..... A47G 23/03 215/393
5,119,279 A * 6/1992 Makowsky ..... A47G 19/2227 362/101
5,785,407 A * 7/1998 Ratcliffe ..... F21V 23/04 362/101
8,459,821 B1 * 6/2013 Fusilier ..... F21V 33/0004 362/101
10,213,032 B1 * 2/2019 Fontaine-Cole ... B65D 25/2811
2005/0243541 A1 * 11/2005 Sibbett ..... F21V 21/088 362/104
2006/0114197 A1 * 6/2006 Sibbett ..... G09G 3/30 345/76
2016/0284965 A1 * 9/2016 Makosinski ..... H01L 35/32
2018/0356088 A1 * 12/2018 Horne ..... A47G 23/0216

* cited by examiner

*Primary Examiner* — Laura K Tso
(74) *Attorney, Agent, or Firm* — Orin Del Vecchio

(57) ABSTRACT

A drinking vessel configured to have an integrated first light source and a second light source so as to broadcast light in a first direction and a second direction. The drinking vessel of the present invention includes an integrally formed bottom and wall wherein the wall has an exterior surface. The first light source is secured to the exterior surface of the wall and is operable to project a light beam outwards from said body. The second light source is circumferentially disposed around the body proximate the lower end of the body. The second light source is configured to broadcast a light beam downwards from the vessel and around thereto. A handle is provided and the handle has a power supply disposed therein and is further configured with a switch to operate the first light source and second light source.

8 Claims, 1 Drawing Sheet

DRINKING VESSEL WITH DIRECTIONAL ILLUMINATION

FIELD OF THE INVENTION

The present invention relates generally to novelty items, more specifically but not by way of limitation, a drinking vessel configured to receive, store and make accessible a beverage for consumption wherein the drinking vessel of the present invention further includes a first light source and a second light source.

BACKGROUND

As is known in the are there are thousands of different types of drinking vessels. Conventional drinking vessels range from numerous types of glasses, pitchers and mugs. It is further widely understood that individuals will often carry a beverage while participating in numerous activities. These activities can include but are not limited to sporting events and various outdoor activities such as camping and hiking. As beverages are often carried in the hand of the user, this eliminates the availability of one hand and as such during some tasks can create some cumbersome or challenging scenarios.

By way of example but not limitation, if an individual is traversing through an area that has low light conditions or at night, that individual will typically desire to carry a portable flashlight in order to traverse safely through the area. In the aforementioned scenario this limits the ability of the user to carry any additional item via their hands and further renders unavailable both of the individuals hands which could be undesirable for many scenarios. The need to provide sufficient light without having to forego the opportunity to transport a beverage or render unavailability of both hands of a user during certain activities is undesirable and can even present a safety risk.

Accordingly, there is a need for a drinking vessel that is configured to store and make available a liquid for consumption wherein the vessel is further configured to provide a directional light as well as area light for a user.

SUMMARY OF THE INVENTION

It is the object of the present invention to provide a drinking vessel that is configured to receive, store and make available a liquid for consumption wherein the present invention includes a body having an interior volume configured to retain a liquid.

Another object of the present invention is to provide a drinking vessel that is configured to have a first light source and a second light source wherein the first light source and second light source provide alternate directional patterns of light wherein the first light source is located on the sidewall of the body.

A further object of the present invention is to provide a drinking vessel that is configured to receive, store and make available a liquid for consumption wherein the first light source projects a light beam outward from the body of the present invention.

Still another object of the present invention is to provide a drinking vessel that is configured to have a first light source and a second light source wherein the first light source and second light source provide alternate directional patterns of light wherein the second light source is circumferentially disposed around the body proximate the bottom edge.

An additional object of the present invention is to provide a drinking vessel that is configured to receive, store and make available a liquid for consumption wherein the second light source emits a light pattern that is a circumferential pattern relative to the body.

Yet a further object of the present invention is to provide a drinking vessel that is configured to have a first light source and a second light source wherein that further includes a top member that is releasably secured to the upper end of the body in a first position and the lower end in the second position.

Another object of the present invention is to a provide a drinking vessel that is configured to receive, store and make available a liquid for consumption wherein the preferred embodiment of the present invention includes a handle.

An alternate object of the present invention is to provide a drinking vessel that is configured to have a first light source and a second light source wherein the handle includes a operational switch for the first light source and second light source.

Still a further object of the present invention is to provide a drinking vessel that is configured to receive, store and make available a liquid for consumption wherein a power supply is disposed within the handle and further includes a charging port integrated thereinto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
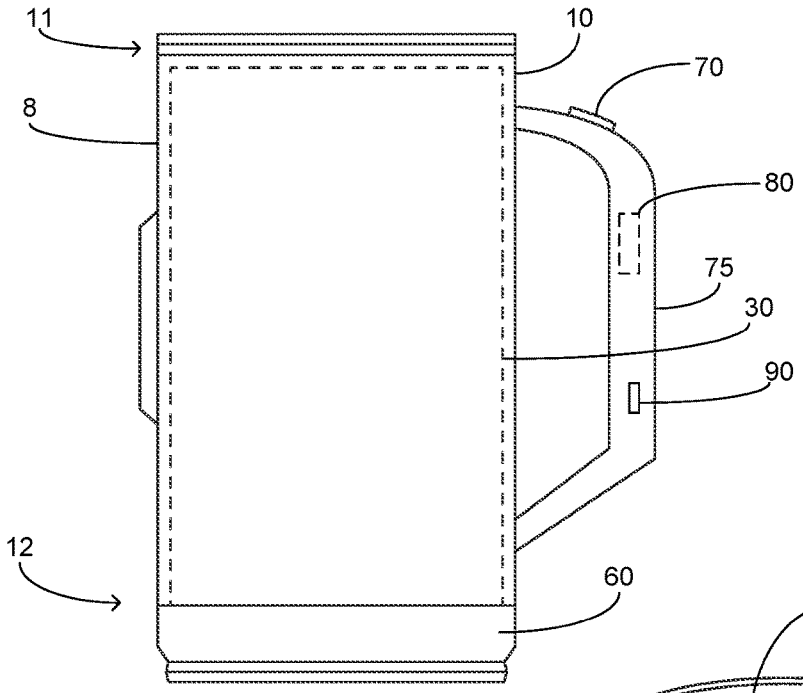
FIG. 1 is a side view of an embodiment of the present invention.
Figure 2:
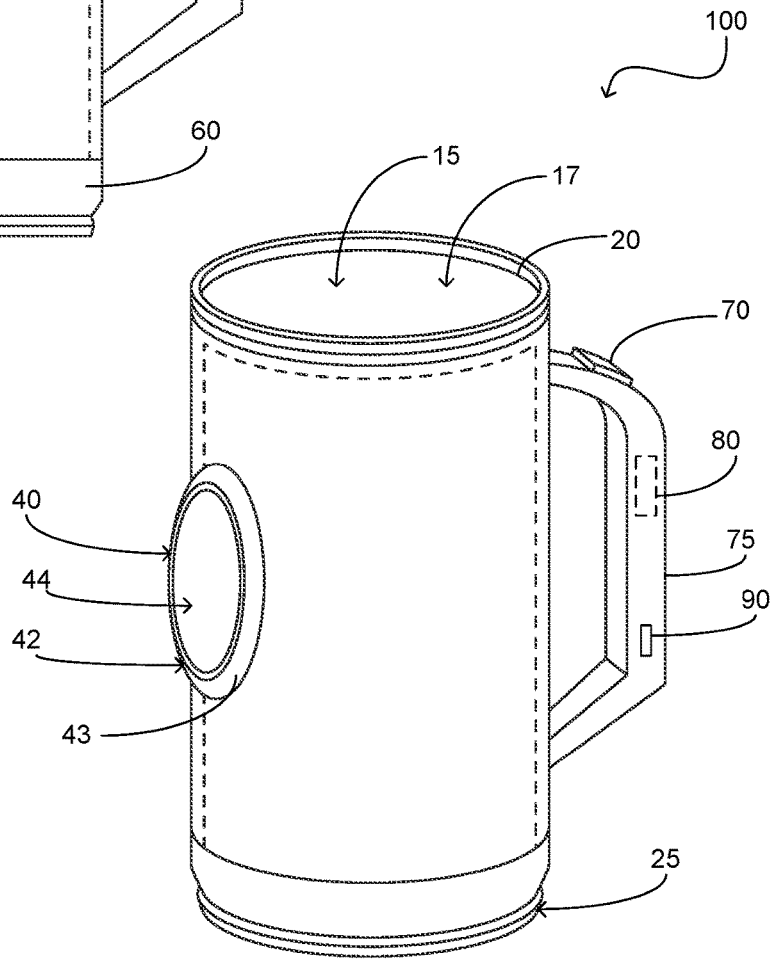
FIG. 2 is a perspective view of the present invention.

Referring now to the drawings submitted herewith, wherein various elements depicted therein are not necessarily drawn to scale and wherein through the views and figures like elements are referenced with identical reference numerals, there is illustrated an illuminated drinking vessel 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the an illuminated drinking vessel 100 includes a body 10 wherein the body 10 is cylindrical in shape having an upper end 11 and a lower end 12. The body 10 includes an opening 15 at the upper end 11 wherein the opening 15 provides access to the interior volume 17 wherein the interior volume 17 is configured to receive and store a liquid for subsequent consumption. It should be understood within the scope of the present invention that the body 10 could be formed in alternate sizes and or shapes and achieve the desired objective discussed herein. By way of example but not limitation, the body 10 could include a plurality of exterior wall to create an alternate shape to the shape illustrated herein. The upper edge 20 is formed having threads circumferentially disposed thereon. The upper edge 20 is configured to releasably secure the top 25 in its first position. The top 25 is operable to cover the opening in its first position and be releasably secured the lower end 12 in its second position. The lower end 12 includes mateable threads formed thereon operable to secure the top 25 in its second position. It is contemplated within the scope of the present invention that the top 25 could be secured utilizing alternate techniques and/or elements in its first and second position. Both the top 25 and the body 10 are manufactured from a suitable durable material such as but not limited to plastic. It should be understood within the scope of the present invention that the top 25 is mateably shaped with the opening 15 and which could be provided in alternate shapes. In a preferred embodiment of the present invention the body 10 includes an insert 30 wherein the insert in manufactured from a suitable clear material. The clear material of the insert 30 provides the ability for the second light source 60 to illuminate the interior volume 17 of the body 10 so as to provide an ability to pour a liquid thereinto in low light conditions.

Formed in the exterior wall 8 of the body 10 is the first light source 40. The first light source 40 is operably coupled to the power source 80. The first light source 40 is configured to provide a directional light beam that projects outward from the body 10. The first light source 40 is utilized similarly to a conventional flashlight wherein the first light source 40 will illuminate an area in front of the user of the illuminated drinking vessel 100. The first light source 40 includes lens assembly 42 having mounting ring 43 and lens 44 which are releasably secured utilizing suitable techniques so as to provide access to a light bulb in order to replace if needed. While illustrated herein as being oval in shape, it should be understood within the scope of the present invention that the first light source 40 could be provided in alternate sizes and shapes. Furthermore, it should be understood within the scope of the present invention that the first light source could be located in alternate positions on the exterior wall 8 of the body 10.

Integrally formed with the body 10 is the second light source 60. The second light source 60 is circumferentially present around the entire diameter of the body 10 so as to project a light beam that will be generally beneath and slightly outward from the lower end 12 of the body 10. The second light source 60 is operably coupled to the power source 80 and in a preferred embodiment is a LED light. While in a preferred embodiment the second light source 60 is circumferentially disposed around the lower end 12 it is contemplated within the scope of the present invention that the second light source 60 could be partially disposed around the diameter of the body 10.

A handle 75 is secured to the body 10 utilizing suitable techniques and is configured to provide a technique to grasp the illuminated drinking vessel 100. The handle 75 while illustrated having a particular form herein could be provided in various styles and shapes. The handle 75 has switch 70 operably secured thereto. Switch 70 is operably coupled to the first light source 40 and second light source 60 in order to provide control of an on or off status of each. The switch 70 is a conventional three way switch that provide activation of either the first light source 40, second light source 60 or both simultaneously. A power supply 80 is disposed within the handle 75 and in the preferred embodiment is a rechargeable lithium ion battery. Port 90 provides access to a charging device so as to provide recharging of the power supply 80.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A drinking vessel configured to provide illumination of an area proximate thereto wherein the drinking vessel comprises:

a body, said body having at least one wall and a bottom contiguously formed to create an interior volume, said body having an upper end and a lower end, said body having an opening at said upper end providing access to the interior volume;

a first light source, said first light source being secured to said at least one wall, said first light source configured to broadcast light outward from said body in a direction perpendicular to said body; and a second light source, said second light source being formed with said at least one wall of said body proximate said lower end, said second light source at least partially disposed around a circumference of said body proximate said lower end and configured to broadcast a light beam in an area under the drinking vessel and proximate thereto, and a clear insert disposed within said body, said clear insert permitting light from said second light source to illuminate the interior volume of the body.

2. The drinking vessel as recited in claim 1, and further including a handle, said handle being secured to said body.

3. The drinking vessel as recited in claim 2, and further including a switch, said switch being operably coupled to said first light source and said second light source so as to provide operation thereof.

4. The drinking vessel as recited in claim 3, wherein the handle includes a power supply disposed therein.

5. The drinking vessel as recited in claim 4, wherein said handle further includes a charging port formed therein operably coupled to said power supply.

6. A drinking vessel configured to broadcast light in a first direction and a second direction wherein the drinking vessel comprises:

a body, said body having a wall and a bottom contiguously formed to create an interior volume, said body having an upper end and a lower end, said body having an opening at said upper end providing access to the interior volume, said body being cylindrical in shape, said body having a handle;

a first light source, said first light source including a mounting ring and lens secured to said wall of said body, said first light source configured to broadcast light outward from said body and perpendicular thereto, said first light source being located approximately at a midpoint of said wall of said body being intermediate said upper end and said lower end; and a second light source, said second light source being formed with said wall of said body proximate said lower end, said second light source being circumferentially disposed around a circumference of said body proximate said lower end, said second light source configured to project a light beam underneath the body and in an area proximate thereto in a downwards direction, and a clear insert disposed within said body, said clear insert permitting light from said second light source to illuminate the interior volume of the body.

7. The drinking vessel as recited in claim 6, and further including a switch, said switch being operably coupled to said first light source and said second light source, said switch having multiple positions so as to activate either said first light source and said second light source either independently or simultaneously.

8. The drinking vessel as recited in claim 7, and further including a power supply, said power supply being disposed in said handle, said power supply further being accessible operably via a charging port in said handle.

* * * * *